US005094320A

United States Patent [19]

Deitz et al.

[11] Patent Number: 5,094,320

[45] Date of Patent: Mar. 10, 1992

[54] LADDER IMPROVEMENT

[76] Inventors: Bernard Deitz, 24 Montvue Dr., Lewisburg, W. Va. 24901; George Spector, 233 Broadway, New York City, N.Y. 10007

[21] Appl. No.: 645,786

[22] Filed: Jan. 25, 1991

[51] Int. Cl.[5] ..... E06C 7/44

[52] U.S. Cl. ..... 182/204; 248/188.8

[58] Field of Search ..... 182/204, 201, 205; 248/188.8, 188.2

[56] References Cited

U.S. PATENT DOCUMENTS

| | | | |
|---|---|---|---|
| 1,346,831 | 7/1920 | Lehmann | 182/201 |
| 1,419,748 | 6/1922 | Miller | 182/204 |
| 2,115,395 | 4/1938 | Marvin | 182/204 |
| 2,249,304 | 7/1941 | Wilson | 182/201 |
| 4,852,689 | 8/1989 | Erion | 182/204 |

FOREIGN PATENT DOCUMENTS

| | | | |
|---|---|---|---|
| 112531 | 2/1940 | Australia | 182/204 |

*Primary Examiner*—Reinaldo P. Machado

[57] ABSTRACT

A ladder leveling device for a ladder having a pair of side rails with connecting rungs is provided and consists of a pair of U-shaped channel members which are each slideably retained to each side rail. A securing mechanism locks each channel member in its adjustable position to enable the ladder to stand upright upon an uneven/inclined surface.

3 Claims, 1 Drawing Sheet

LADDER IMPROVEMENT

BACKGROUND OF THE INVENTION

The instant invention relates generally to ladder accessories and more specifically it relates to a ladder leveling device which provides extension members for enabling the ladder to stand upright upon uneven and inclined surfaces.

There are available various conventional ladder accessories which do not provide the novel improvements of the invention herein disclosed.

SUMMARY OF THE INVENTION

A primary object of the present invention is to provide a ladder leveling device that will overcome the shortcomings of the prior art devices.

Another object is to provide a ladder leveling device that will include a pair of extension members which can be adjustably affixed to the side rails of the ladder for enabling the ladder to stand upright upon uneven and inclined surfaces.

An additional object is to provide a ladder leveling device in which each extension member will include a side retained adjuster to hold the small bracket member more firmly to the long bracket member to reduce slippage on the ladder.

A further object is to provide a ladder leveling device that is simple and easy to use.

A still further object is to provide a ladder leveling device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
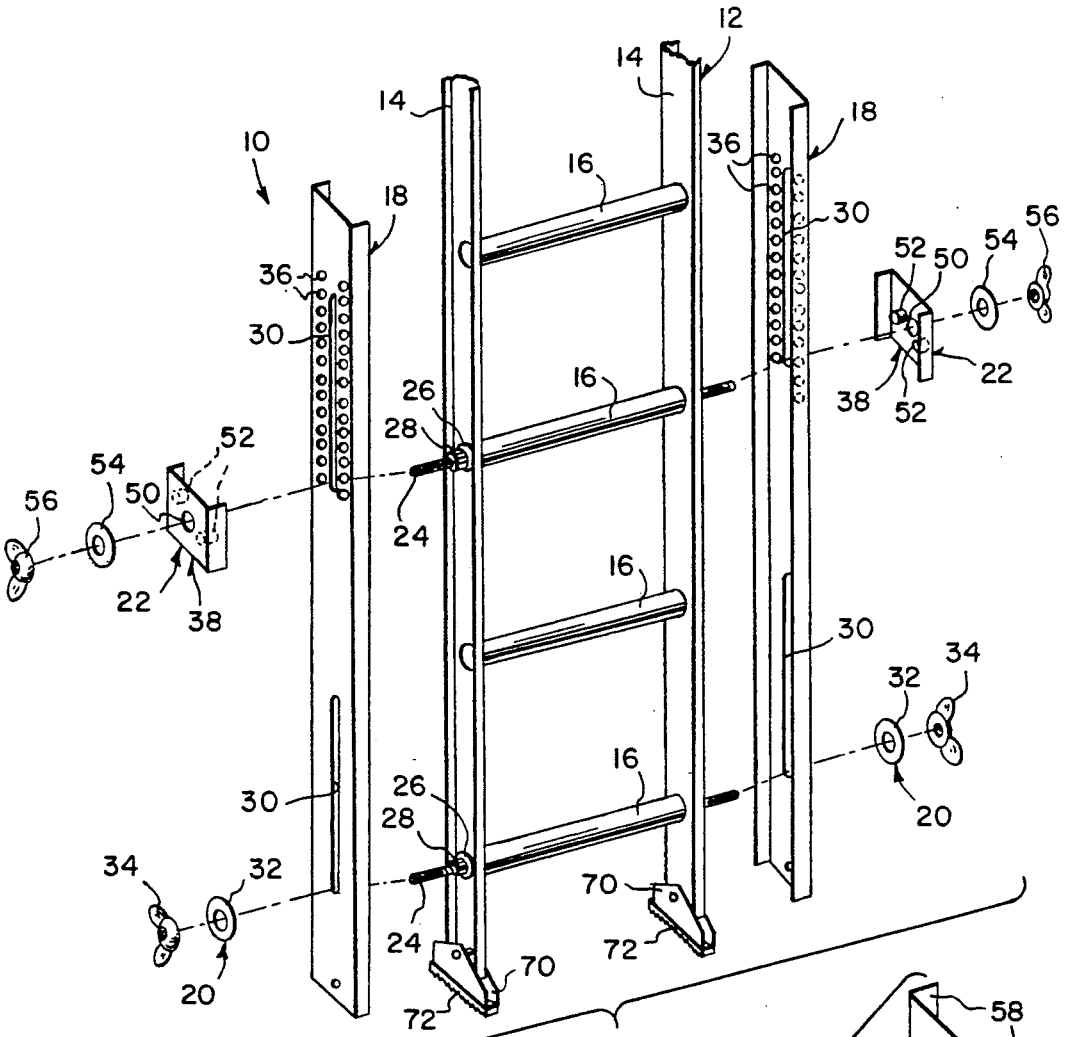
FIG. 1 is is an exploded perspective view of the invention.

Turning now descriptively to the drawings, in which similar reference characters denote similar elements throughout the several views, FIG. 1 illustrates a ladder leveling device 10 for a ladder 12 of the type having a pair of side rails 14 with a plurality of connecting rungs 16. The device 10 consists of a pair of U-shaped channel members 18, each of which is sized to fit over one of the side rails 14 of the ladder 12 adjacent the lower end thereof. A structure 20 is for slideably retaining each of the channel members 18 to each of the side rails 14 of the ladder 12. Each of the channel members 18 can be independently moved to an adjustable position. Another structure 22 is for securing each of the channel members 18 to each of the side rails 14 of the ladder 12 so as to lock each channel member 18 in its adjustable position to enable the ladder 12 to stand upright upon an uneven/inclined surface.

The slideably retaining structure 20 includes a pair of elongated threaded rods 24, each of which fits through one of the connecting rungs 16 to extend at each end out past the side ails 14 of the ladder 12. A washer 26 fits over each end of the threaded rods 24 and a nut 28 threads onto each end of the threaded rods 24 so as to hold the threaded rods 24 in place. Each channel member 18 has a pair of spaced apart longitudinal elongated slots 30 so that the ends of the threaded rods 24 can fit therethrough. Another washer 32 fits over each end of the lower threaded rod 24, while a wing nut 34 threads onto each end of the lower threaded rod 24.

The securing structure 22 includes each channel member 18 having a plurality of vertical spaced apart holes 36 on either side of the upper elongated slot 30. A pair of U-shaped brackets 38 are provided with each having a central aperture 50 and a pair of inwardly facing studs 52 so that each end of the upper threaded rod 24 can fit through each central aperture 50 in each bracket 38, with the two studs 52 engagable with two of the holes 36 in each channel member 18. A washer 54 fits over each end of the upper threaded rod 24, while a wing nut 56 threads onto each end of the upper threaded rod 24.

Figure 2:
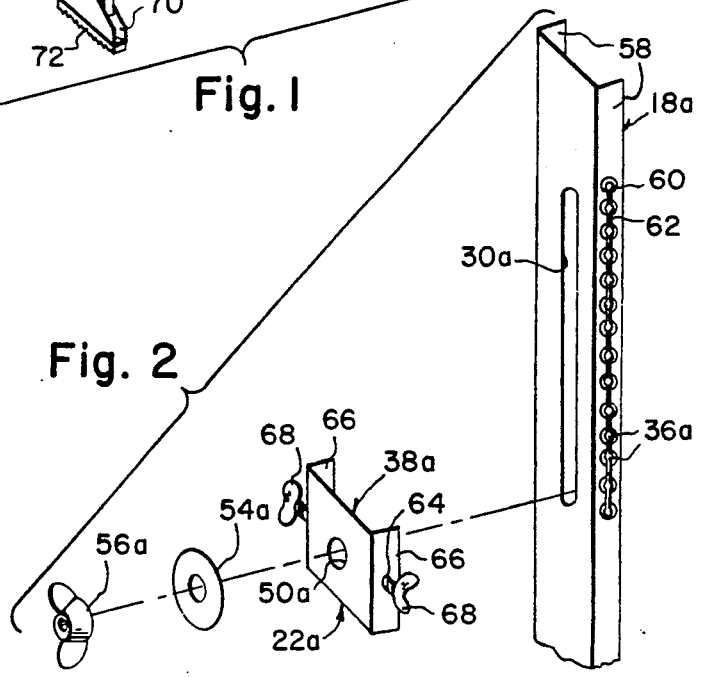
FIG. 2 is is an enlarged exploded perspective view of a portion of a modification showing two wing headed set screws on the U-shaped bracket and a plurality of side holes on the side flanges of the U-shaped channel member to provide a side retained adjuster.

A modified securing structure **22*a* is shown in FIG. 2 and includes each channel member 18*a* having a plurality of spaced apart holes 36*a* on each side flange 58 adjacent the upper elongated slot 30*a*. Each hole 36*a* is countersunk at 60 with a recessed track guide 62 therebetween. A pair of U-shaped brackets 38*a* are provided, with each having a central aperture 50*a* and a pair of threaded holes 64 in each side flange 66 thereof. Each end of the upper threaded rod 24 can fit through each central aperture 50*a* of each bracket 38*a*. A washer 54*a* fits over each end of the upper threaded rod 24, while a wing nut 56*a* threads onto each end of the upper threaded rod 24. A wing head set screw 68 is threadable into each threaded hole 64 in each side flange 66 of the bracket 38*a* to ride within the tack guide 62 and engage with one of the countersunk holes 36*a* in each side flange 58 of each channel member 18*a***.

Self leveling shoes 70 are also provided and may be removed from the bottom of the side rails 14 of the ladder 12 and bolted on the bottom of the channel members 18 or **18*a*. Each shoe 70 has an anti-skid pad 72 to prevent the slippage of the shoe 70**.

If a person is using a wooden ladder with the leveling device 10 instead of a metal ladder, four holes will be drilled under the rungs and four carriage bolts installed through the holes thereby eliminating the elongated threaded rods 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ladder leveling device for a ladder of the type having a pair of side rails with a plurality of connecting rungs, said device comprising:

a) a pair of U-shaped channel members, each of which is sized to fit over one of the side rails of the ladder adjacent the lower end thereof;

b) means for slideably retaining each of said channel members to each of the side rails of the ladder so that each of said channel members can be independently moved to an adjustable position; and c) means for securing each of said channel members to each of the side rails of the ladder so as to lock each said channel member in its adjustable position to enable the ladder to stand upright upon an uneven/inclined surface; wherein said slideably retaining means includes:

d) a pair of elongated threaded rods each of which fits through one of the connecting rungs to extend at each end out past the side rails of the ladder;

e) four washers, each to fit over each end of said threaded rods;

f) four nuts, each to thread onto each end of said threaded rods so as to hold said threaded rods in place;

g) each said channel member having a pair of spaced apart longitudinal elongated slots so that the ends of said threaded rods can fit there through;

h) two of said washers, each to fit over each end of one of said threaded rods; and i) two of said nuts, each to thread onto each end of said one threaded rod.

2. A ladder leveling device as recited in claim 1, wherein said securing means includes:

a) each said channel member having a plurality of vertical spaced apart holes on either side of the upper elongated slot;

b) a pair of U-shaped brackets, each having a central aperture and a pair of inwardly facing studs so that each end of the upper threaded rods can fit through each central aperture in each said bracket with the two studs engagable with two of the holes in each said channel member;

c) two of said washers, each to fit over each end of the other of aid threaded rods; and d) two of said nuts, each to thread onto each end of said upper threaded rod.

3. A ladder leveling device as recited in claim 1, wherein said securing means includes:

a) each said channel member having a plurality of vertical spaced apart holes on each side flange adjacent the upper elongated slot, each hole countersunk with a recessed track guide therebetween;

b) a pair of U-shaped brackets, each having a central aperture and a pair of threaded holes in each side flange thereof, so that each end of the other of said threaded rods can fit through each central aperture of each said bracket;

c) the other two of said four washers, each to fit over each end of said other threaded rods;

d) the other two of said nuts, each to thread onto each end of said other threaded rods; and e) a pair of wing headed set screws, each threadable into one of the threaded holes in one side flange of said bracket to ride within the track guide and engage with one of the countersunk holes in each side flange of each said channel member.

* * * * *